US005823162A

United States Patent [19]

Pavlicek et al.

[11] Patent Number: 5,823,162

[45] Date of Patent: Oct. 20, 1998

[54] WAY OF OPERATION OF DISTRIBUTION MECHANISM OF A FOUR-STROKE INTERNAL COMBUSTION ENGINE

[76] Inventors: Jan Pavlicek, Bohumila Martinu 38, 602 00 Brno, Czech Rep.; Lubos Jakubec, Salmova 1, 678 01 Blansko, Czech Rep.; Mojmir Robes, Sychotin 75, 679 72 Kunstat na Morave, Czech Rep.

[21] Appl. No.: 868,130

[22] Filed: Jun. 3, 1997

[30] Foreign Application Priority Data

Jun. 6, 1996 [CZ] Czech Rep. ..... 1639-96

[51] Int. Cl.[6] ..... F02B 15/00

[52] U.S. Cl. ..... 123/311

[58] Field of Search ..... 123/311, 316

[56] References Cited

U.S. PATENT DOCUMENTS

| | | | |
|---|---|---|---|
| 1,610,888 | 12/1926 | Sauer | 123/316 |
| 2,292,233 | 8/1942 | Lysholm | 123/316 |
| 5,095,881 | 3/1992 | Nishimura et al. | 123/316 |
| 5,228,422 | 7/1993 | Wakeman | 123/316 |

*Primary Examiner*—David A. Okonsky

*Attorney, Agent, or Firm*—Notaro & Michalos P.C.

[57] ABSTRACT

The operation of a distribution system of a four-stroke internal combustion engine, which has suction and exhaustion mechanisms, is based on the principle that the exhaustion mechanism, which opens during an expansion stroke and stays opened during the exhaustion stroke, stays opened also through the whole period of the combustion stroke and it closes only during the period of compression after opening of the suction mechanism.

3 Claims, 1 Drawing Sheet

WAY OF OPERATION OF DISTRIBUTION MECHANISM OF A FOUR-STROKE INTERNAL COMBUSTION ENGINE

FIELD AND BACKGROUND OF THE INVENTION

This invention concerns the way in which the distribution mechanism of a four-stroke internal combustion engine works and solves the problem of increase of output of this engine by better exploitation of energy of exhaust gas.

In contemporary ways of operation of the distribution system of four-stroke internal combustion engine, which consists of a suction mechanism and an exhaustion mechanism, the suction mechanism opens during exhaustion, it remains open in the following suction or intake period and it closes during compression, while the exhaustion mechanism opens during expansion before the exhaustion stroke, it remains open during this process and it closes during suction. With this way of operation of the distribution mechanism a fresh mixture or air is taken up mostly due to underpressure which is created during the suction period due to a movement of a piston from top dead center to bottom dead center. However, this underpressure in the exhaust piping, which appears during distribution overlap, i.e. in the period from opening of the suction mechanism until exhaustion piping closure, is rather short due to a short period of overlap and it can only be used for scavenging of the combustion engine, but not for increase of the filling effect and thus the volumetric efficiency of these engines is rather low.

Increase of the volumetric efficiency in supercharged engines is provided by superchargers, however, their exhaust-driven turbines make exhaustion of the combustion products more complicated, increase heat stress for the engine and make the use of low-octane fuels impossible. Funds spend on turbochargers and their maintenance must also be taken into account.

SUMMARY OF THE INVENTION

The abovementioned disadvantages of the way of operation of the distribution system are not a problem for an engine constructed according to the invention. The main principle of the invention is that the exhaustion or exhaust mechanism stays open during the whole period when the suction or intake mechanism is open and it closes during compression, after closure of the suction mechanism.

This allows, due to a longer overlap of the distribution, to take up fresh mixture or air all the way to the exhaustion piping and it returns back to the valve after the closure of the suction mechanism due to overpressure in the exhaustion piping. This results in increase of the volumetric efficiency without need of supercharging of the engine with a supercharger and also in an intensive cooling of the exhaustion mechanism. Low-octane fuel can be used without knocking combustion in the combustion area.

BRIEF DESCRIPTION OF THE DRAWING

The only figure in the drawing is a schematic illustration which shows the operation of the distribution system according to the invention where the suction interval is indicated by line 1 and the exhaustion interval by line 2.

DESCRIPTION OF THE PREFERRED EMBODIMENT

Figure 1:
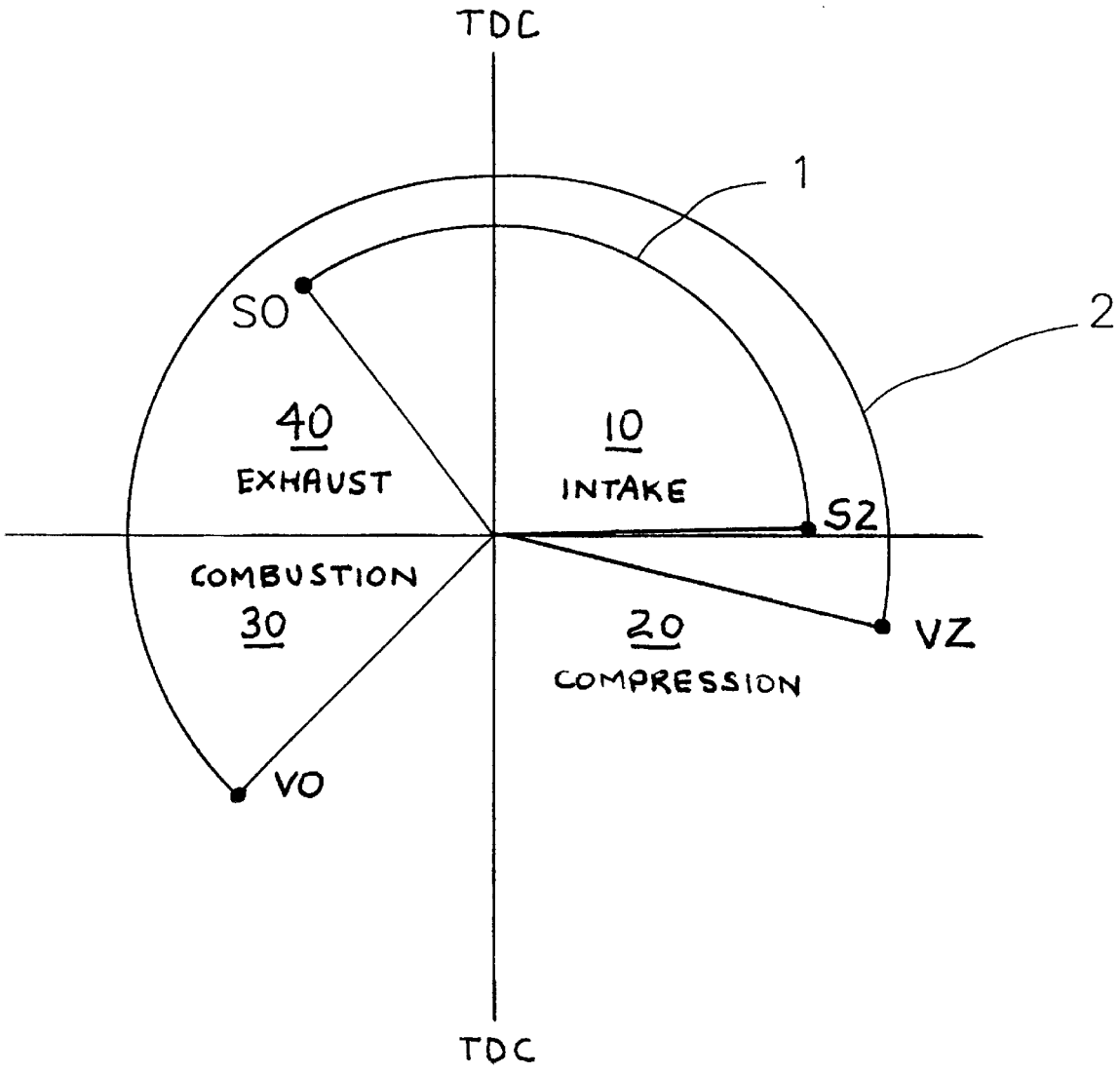

The above-mentioned diagram shows that the suction interval 1 starts with opening of the suction mechanism at point SO, it continues through exhaustion and it ends with closure of this mechanism at point SZ. The exhaustion interval 2, on the other hand, starts with opening of the exhaustion mechanism at point VO during the expansion stroke, lasts through the whole period of the exhaustion stroke and through the whole period of take up or suction and it ends with the closure of the exhaustion piping during compression at point VZ. This system creates a longer period of overlap of distribution which allows the suction of a fresh mixture to be taken up not only to the cylinders, but also to the exhaust tube or piping directly behind the exhaust mechanism.

The mixture is sucked with the help of the underpressure, which is produced in the exhaust manifold of a big cross section after the pressing out of the gases by a pressure wave. The underpressure must not be disturbed by the recoil of the pressure wave nor by the premature input of the atmospheric pressure for enabling the activity of the underpressure for the whole period of the opening of the suction mechanism. For this reason, there is no sound damper (muffler) or catalyst converter which would recoil from the higher pressure waves, introduced into the exhaust system. Also the total length of the exhaust manifold is at least one half of the distance which is covered by the pressure wave with the speed of sound at the given temperature and the given pressure from the moment of the opening of the exhaust mechanism until the closing of the suction mechanism, which makes the entry of the atmospheric pressure into the manifold impossible. The connection of the individual exhaust collecting tubes is at the engines with more than one cylinder carried out in such a way, that the cylinders are divided into groups of two or no more than three cylinders according to the sequence of the ignition. The lengths of the collecting tubes are arranged in such a way, that the pressure wave, which comes out of the following cylinder in the sequence, comes back to the engine under the influence of the collecting tubes immediately after the closing of the suction mechanism. The expansion of the pressure reaches so its maximum before the closing of the exhaust mechanism and the mixture comes back to the cylinder under a pressure, which is higher than atmospheric pressure.

The operation of a distribution system based on the invention is suitable for two- and four-cylinder internal combustion engines with fuel injection and will apply especially in heavy-duty car engines which cannot be supercharged and also in hydrogen-driven engines.

In the drawing, the initials "SO", not only identify the beginning of the suction, intake or take-up stroke when the suction mechanism is open, but also illustrates the suction mechanism in its entirely, including all known parts of the suction mechanism such as carburation mechanisms or fuel injectors, air intakes with filters, and other known elements of conventional suction mechanisms for internal combustion engines. "SZ", likewise, illustrates both the end of the suction stroke when the suction mechanism is closed and also all of the hardware needed to close the mechanism such as appropriate valves, valve lifters, cam shafts and the like. The initials "Vo", likewise, illustrate both the point at which the exhaust mechanism is opened and also the exhaust mechanism itself including the exhaust manifold leading from the cylinder in which the various strokes take place and the exhaust piping or system all the way to the exhaust pipe of the internal combustion engine. The initials "VZ", likewise, illustrate both the end of the exhaust stroke when the exhaust mechanism is closed, as well as the appropriate closing mechanisms such as exhaust valves, valve lifters, cam shafts and the like. The schematic illustration of the exhaust system also anticipates and exhaust system without muffler and without catalytic converter in the preferred embodiment of the invention.

In the figure, quadrant 10 in the circle which represents the full cycle of the four-cycle internal combustion engine, is the intake quadrant of time during which the piston is descending in the cylinder. Quadrant 20 is the compression stroke during which the cylinder rises, compressing the fuel plus air mixture. Quadrant 30 is the combustion stroke during which the pressure of combustion pushes the cylinder downwardly and creates exhaust gases, and quadrant 40 is the exhaust stroke during which the piston rises in the cylinder once more, and discharges the combustion products. The phase of the four strokes may be rotated to optimize operation, with respect to the opening and closing of the suction and exhaust mechanisms at the first time (SO), at the second time (VO), at the third time (SZ), and at the fourth time (VZ).

What is claimed is:

1. A method of operating a distribution system of a four-stroke internal combustion engine having an intake stroke, a compression stroke, a combustion stroke and an exhaust stroke, including a suction mechanism for drawing a gaseous mixture of air and fuel into a cylinder, and an exhaust mechanism for exhausting combustion products from the cylinder, the method comprising:

opening the exhaust mechanism to exhaust combustion products of the internal combustion engine from the cylinder during the combustion stroke, the exhaust mechanism being open for a period of at least 410° of a 720° four-stroke cycle;

opening the suction mechanism to draw the gaseous mixture into the cylinder during the exhaust stroke after the exhaust mechanism is opened;

closing the suction mechanism to close the cylinder and prevent take-up of the gaseous mixture into the cylinder before a bottom turning point of the intake stroke; and closing the exhaust mechanism to stop exhaust of the combustion products from the cylinder during the compression stroke.

2. A method according to claim 1, wherein a second period between closing the exhaust mechanism and opening the suction mechanism is longer than an overfill period between closing the suction mechanism and closing the exhaust mechanism.

3. A method according to claim 1, wherein closing the suction mechanism occurs at the beginning of the compression stroke.

* * * * *